US005613917A

United States Patent [19]

Kobayashi et al.

[11] Patent Number: 5,613,917

[45] Date of Patent: Mar. 25, 1997

[54] GOLF CLUB HEAD WITH PERIPHERAL BALANCE WEIGHTS

[75] Inventors: Kenji Kobayashi; Hitoshi Takeda, both of Tsubame, Japan

[73] Assignee: K.K. Endo Seisakusho, Japan

[21] Appl. No.: 584,946

[22] Filed: Jan. 16, 1996

Related U.S. Application Data

[62] Division of Ser. No. 250,431, May 27, 1994.

[30] Foreign Application Priority Data

| | | | |
|---|---|---|---|
| May 31, 1993 | [JP] | Japan | 5-129627 |
| Jul. 22, 1993 | [JP] | Japan | 5-181685 |
| Oct. 4, 1993 | [JP] | Japan | 5-248195 |
| Mar. 30, 1994 | [JP] | Japan | 6-61178 |

[51] Int. Cl.[6] ..... A63B 53/04

[52] U.S. Cl. ..... 473/335

[58] Field of Search ..... 473/334, 335, 473/336, 337, 338, 339, 349, 350

[56] References Cited

U.S. PATENT DOCUMENTS

| | | | |
|---|---|---|---|
| 1,504,380 | 8/1924 | Reitenour | 473/325 |
| 1,538,312 | 5/1925 | Beat | 473/337 |
| 3,847,399 | 11/1974 | Raymont | 473/350 |
| 3,955,820 | 5/1976 | Cochran et al. | 473/337 |
| 4,213,613 | 7/1980 | Nygren | 473/337 X |
| 4,919,431 | 4/1990 | Antonious | 473/350 |
| 5,209,473 | 5/1993 | Fisher | 473/335 X |
| 5,419,560 | 5/1995 | Bamber | 473/350 |
| 5,439,223 | 8/1995 | Kobayashi | 473/334 |

FOREIGN PATENT DOCUMENTS

| | | | |
|---|---|---|---|
| 1232651 | 5/1971 | United Kingdom | 273/191 |

*Primary Examiner*—William H. Grieb
*Attorney, Agent, or Firm*—Quarles & Brady

[57] ABSTRACT

An iron or putter golf club head having a larger sweet area and the lower center of gravity. Weights 12*a* and 13*a* of beryllium copper alloy are provided along peripheral portions of a head body 11*a* of titanium alloy at its face 1*a* and back 2*a* side respectively. Specifically, the back weight 13*a* has a weight-sole portion 20*a* integrally extending down to a sole 3*a*. The weight-sole portion 20*a* is widened at its toe and heel sides relative to its intermediate portion. Thus, the weight distribution of the head is capable of being greatly concenterated on the peripheral portion of the head to enlarge a sweet area. In addition, owing to the weight-sole portion 20*a*, the center of gravity can be effectively lowered.

4 Claims, 5 Drawing Sheets

GOLF CLUB HEAD WITH PERIPHERAL BALANCE WEIGHTS

CROSS REFERENCE TO RELATED APPLICATIONS

This application is a divisional application of U.S. Ser. No. 08/250,431, filed May 27, 1994, now pending.

BACKGROUND OF THE INVENTION (a) Field of the Invention

The present invention relates to a golf club head, especially so-called an iron golf club head or a putter golf club head.

(b) Description of Prior Art

It is mainly for the purpose of enlarging so-called a sweet area and lowering the center of gravity of a golf club head that the weight distribution of a golf club head including an iron golf club head or the like is adjusted in an invention related to a golf club head. It is well recognized by those skilled in the art that to enlarge a sweet area, the center of gravity of a club head should be positioned comparatively backward, and/or, the weight distribution of a golf club head should be concentrated upon a peripheral portion of a main body of a head besides the enlargement of a bulk of a golf club head itself. On the other hand, it is mainly for the purpose of making a golf ball travel more upwardly and a longer distance to lower the center of gravity of a club head. One of the representative of a means for realizing such weight distribution is disclosed in U.S. Pat. No. 3,847,399, in which a head body is formed hollow, or a back surface of a club head is formed with a cavity.

However, especially for an iron club head, it is difficult to make the same hollow. Further, only a cavity formed in a back surface of a club head made of a single material cannot sufficiently concentrate the weight distribution of a club head upon a peripheral portion, thus setting limits to enlargement of a sweet area. Furthermore, although there is proposed another golf club head where a balance weight made of beryllium copper alloy is secured to a lower side of the back of the head body made of the titanium alloy without weighting the whole weight any more, which structure yet has set limits to enlargement of a sweet area as well.

As described above, as conventional iron or putter golf club heads have been formed integral as a whole, a relatively smaller sweet area have been attained, which has been also resulted with respect to the above prior golf club head having the denser balance weight secured to the lower side of the back.

SUMMARY OF THE INVENTION

It is, therefore, an object of the present invention to drastically enlarge a sweet area in a golf club head.

According to a major feature of the present invention, a golf club head comprises: a head body having a face and a back; two separate balance weights formed of a material denser than that of said head body, comprising: a first balance weight provided along a peripheral portion of the face of said head body; a second balance weight provided along a peripheral portion of the back of said head body.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE PREFERRED EMBODIMENTS

Figure 1:
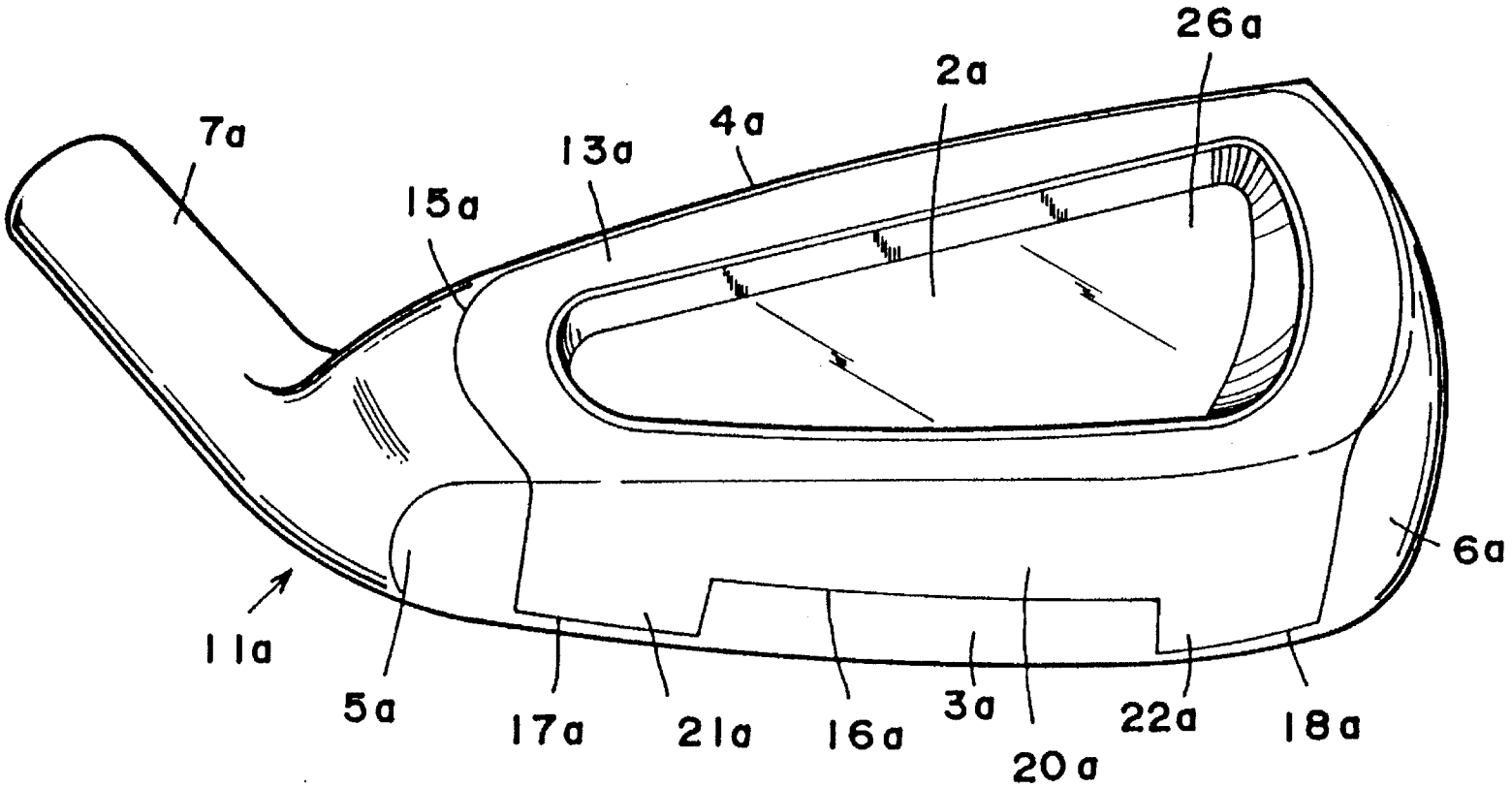
FIG. 1 is a rear perspective view showing a first embodiment of a golf club head of the invention.

Hereinafter are described embodiments of the present invention with reference to the drawings. In reference numerals attached to the drawings, alphabetical small letters attached to each reference number sequently indicate the number of each embodiment.

Figure 2:
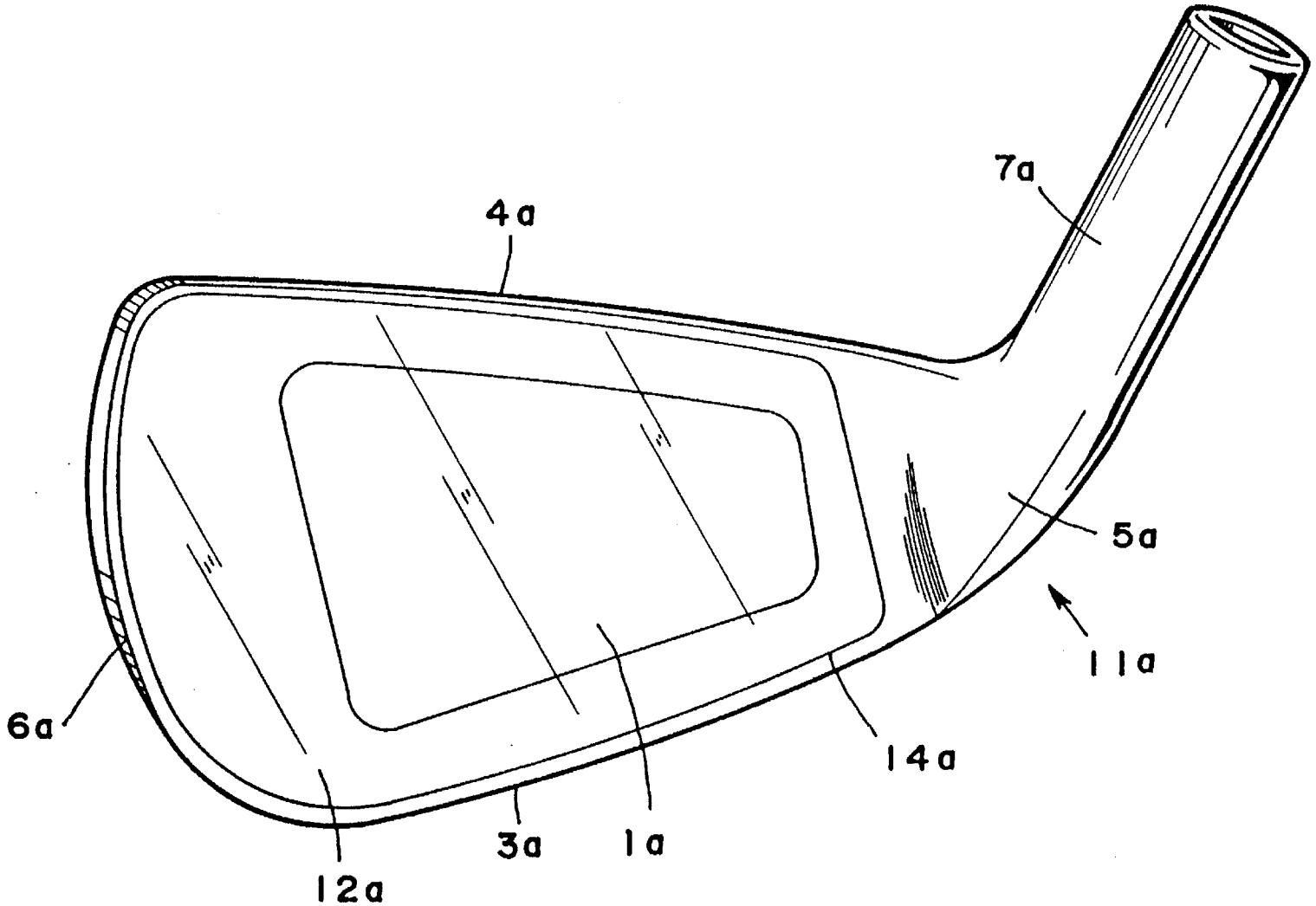
FIG. 2 is a front perspective view showing a first embodiment of a golf club head of the invention.
Figure 3:
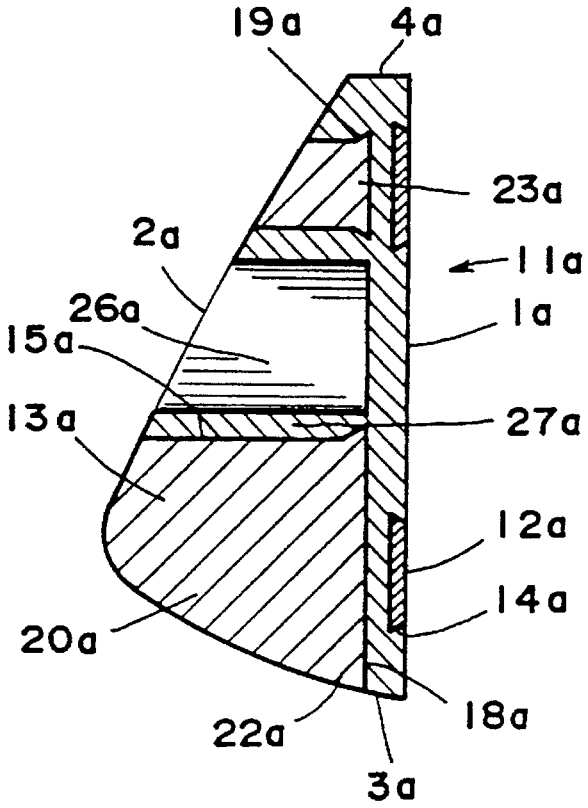
FIG. 3 is a section showing a first embodiment of a golf club head of the invention.

In FIGS. 1 to 3 showing a first embodiment of the invention, a reference numeral 1*a* designates a face, 2*a* a back, 3*a* a sole, 4*a* a top, 5*a* a heel, 6*a* a toe and 7*a* a neck for connecting a shaft thereto respectively. A golf club head of the embodiment is so-called an iron-type club head, comprising a head body 11*a* and weights 12*a* and 13*a*. The head body 11*a* is made of titanium alloy (the specific gravity approx. 4.5) which forms a greater part of the golf club head. Weights 12*a* and 13*a* are each made of beryllium copper alloy (the specific gravity approx. 8.2), with the weight 12*a* at the face side forming a part of the face 1*a* and the weight 13*a* at the back side a part of the back 2*a* and sole 3*a*.

Along a peripheral portion of the head body 11*a* at the face 1*a* side is formed an annular concave embedding groove 14*a*. The embedding groove 14*a* is dovetail-shaped, tapering in the back-to-front direction. Into the embedding groove 14*a* is press-fitted the annular weight 12*a*. Thus, the annular weight 12*a* is firmly secured to the head body 11*a* by the mortise/tenon joint. On the other hand, along a peripheral portion of the head body 11*a* at the back 2*a* side is formed another annular concave embedding groove 15*a*. The embedding groove 15*a* has an extension portion 16*a* extending down to the sole 3*a*. The extending embedding portion 16*a* further has an elongated recess 17*a* at heel 5*a* side, and another elongated recess 18*a* at toe 6*a* side. In addition, a bottom portion of the embedding groove 15*a* is dovetail-shaped adjacent the face 1*a* side, designated 19*a*, tapering in the front-to-back direction. Into the embedding groove 15*a* is press-fitted said annular weight 13*a*. Corresponding to the above structure of the embedding groove 15*a*, the annular weight 13*a* has a weight-sole portion 20*a* at a lower side to be fitted into the extension portion 16*a* of the embedding groove 15*a*, further having protrusions 21*a* and 22*a* which respectively fit into the elongated recesses 17*a* and 18*a* of the extension portion 16*a*. Accordingly, the weight-sole portion 20*a* is more thickened at its heel 5*a* and toe 6*a* sides than at its intermediate portion. Likewise, a distal end of the weight 13*a* is widened, as designated a widened portion 23*a* to be fitted into the dovetail-shaped portion 19*a* of the embedding groove 15*a*, thereby ensuring the firm securing of the head body 11*a* to the weight 13*a*.

In a preferred form of the invention, an area on the back 2*a* surrounded by the annular weight 13*a* is formed with a concave cavity 26*a*. And there is provided a cover portion 27*a* contacting the inner surface of the weight 13*a*, said cover portion 27*a* being integral with the head body 11*a*.

Now the method for manufacturing the above-structured golf club head will be described.

The head body 11*a* is basically formed by forging process, and either at the same time or after that, the embedding grooves 14*a* and 15*a* are each formed by machining. In the same manner, the weights 12*a* and 13*a* are each formed by forging. Then, the back weight 13*a* is cold pressed into the embedding groove 15*a* at the back 2*a* side of the head body 11*a*. During such cold press-in process, the distal end of the weight 13*a* is subjected to a plastic deformation, thus forming widened portion 23*a* to be fitted into the dovetail portion 19*a* of the embedding groove 15*a*. Likewise, the face weight 12*a* is cold pressed into the embedding groove 14*a*. During such cold press-in process, the weight 12*a* is subjected to a plastic deformation to be firmly fitted into the embedding groove 14*a* by mortise/tenon joint. After the above press-in processes, a cavity 26*a* is formed by milling with the use of a machining center.

According to the structure shown in a first embodiment, as the weights 12*a* and 13*a* made of beryllium copper alloy are embedded in the peripheral portions of the head body 11*a* at both the face 1*a* and back 2*a* sides with the cavity 26*a* provided in the center of the back 2*a* thereof, the weight distribution of the whole head can be greately concentrated on the peripheral portion thereof relative to the face 1*a*, with the whole weight of the club head being kept within a regular value. Further, the back weight 13*a* larger than the face weight 12*a* allows the center of gravity of the whole head to be positioned still backwards, thus greatly enlarging a sweet area. Furthermore, as the back weight 13*a* is provided with the weight-sole portion 20*a* extending down to the sole 3*a*, the center of gravity of the whole head can be positioned still lowerly and backwards. Specifically, the weight-sole portion 20*a* is relatively widened at its toe 6*a* and heel 5*a* sides, the weight distribution in the sole 3*a* also can be effectively allotted to the toe 6*a* and heel 5*a* sides, thereby further enlarging a sweet area. In addition, as the depth of the center of gravity of the head body 11*a* can be greater owing to the above weight-sole portion 20*a*, the balls are capable of travelling more easily upward and a longer distance. As a result, a golf club head with which balls can be more easily controlled can be provided.

Figure 4:
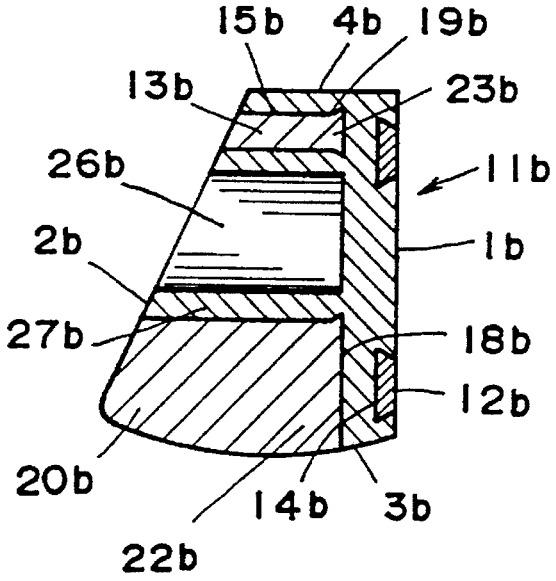
FIG. 4 is a section showing a second embodiment of a golf club head of the invention.

In FIG. 4 showing a second embodiment, the above-mentioned structure is applied to a putter golf club head, in which the same reference numbers designating the same portions as those described in a first embodiment are used with the alphabetical small letter "b"s attached to respectively.

Figure 5:
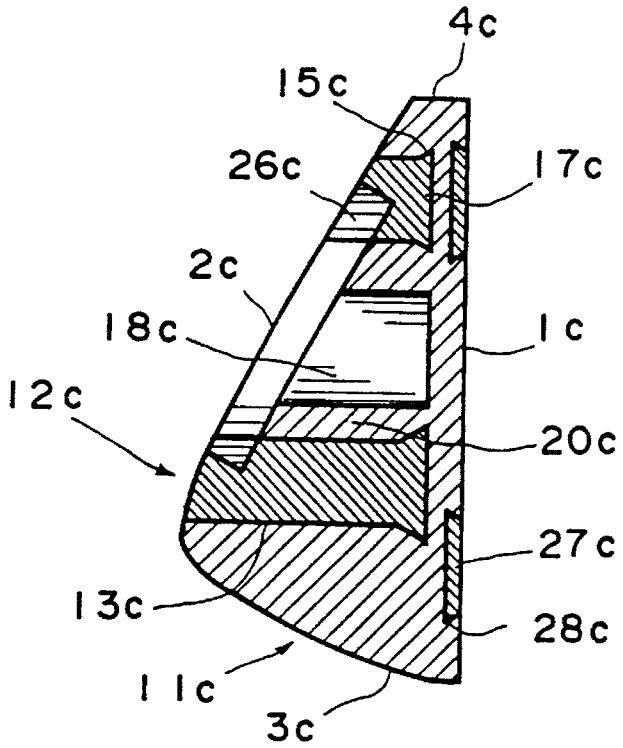
FIG. 5 is a section showing a third embodiment of a golf club head of the invention.
Figure 6:
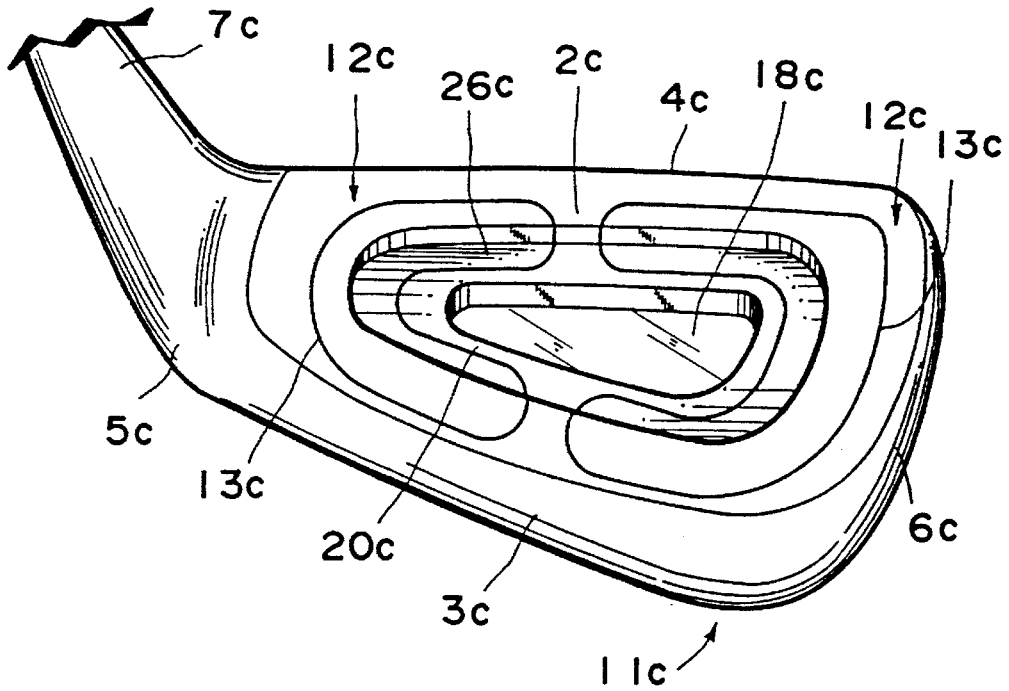
FIG. 6 is a rear perspective view showing a third embodiment of a golf club head of the invention.
Figure 7:
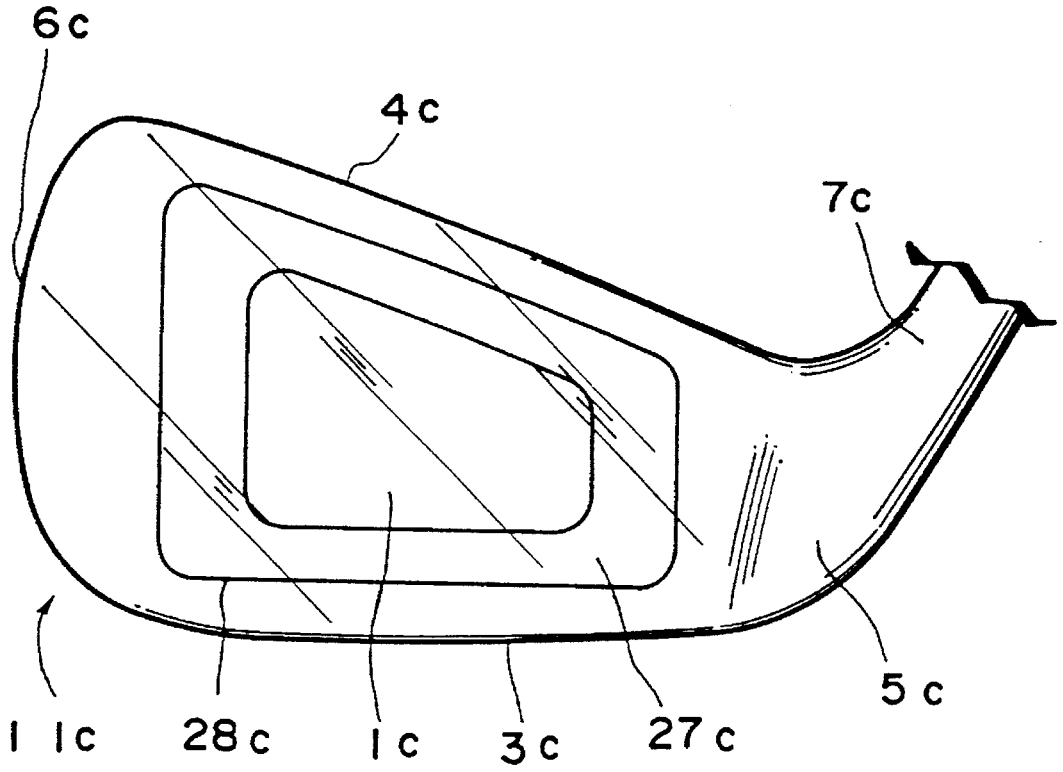
FIG. 7 is a front view showing a third embodiment of a golf club head of the invention.

Referring to FIGS. 5 to 7 showing a third embodiment of the invention, a back weight 12*c* is embedded in nearly the entire length of the peripheral portion of the head body 11*c* at the back 2*c* side, which in this embodiment is divided into two parts at the heel 5*c* and toe 6*c* side. In other words, there are provided a pair of the semi-annular back weights 12*c*, which are each pressed in a pair of the embedding grooves 13*c* formed in the head body 11*c*. Further, a back part of a cavity 18*c* is formed with a wide recess 26*c* which spans across an inner periphery of the back weight 12*c*. The wide recess 26*c* is machined after embedding the back weight 12*c* into the head body 11*c*. During that machining process, the inner periphery of the back weight 12*c* is also machined.

In addition, there is also provided an annular face weight 27*c* made of beryllium copper alloy along a peripheral portion of the head body 11*c* at the face 1*c* side. The face weight 27*c* is pressed into a dovetail-shaped groove 28*c* formed in the face 1*c*, which is, like the back weight 12*c*, firmly secured to the head body 11*c*.

According to a third embodiment of the invention, the back weight 12*c* is divided into two parts at the heel 5*c* and toe 6*c* sides respectively, thereby positively distributing the whole weight of the club head to stabilize the traveling direction of balls. Further, a suitable dimension or configuration of the cavity 18*c* can be set when forming the above wide recess 26*c*, whereby the weight distribution of the head can be adjusted. Additionally, the face weight 27*c* provided along the peripheral portion at the face 1*c* side permits the weight distribution of the head to be concentrated on the peripheral portion thereof, thereby stabilizing the travelling of balls.

Incidentally, the present invention should not be limited to the foregoing embodiments, but may be modified within a scope of the invention. For example, the material of the head body may be other metallic material such as aluminium or pure titainium other than titanium alloy. Furthermore, the material of the weights may be comparatively denser metallic material such as copper alloy or stainless steel (the specific gravity approx. 7.9) other than beryllium copper alloy. In addition, the back and the face weights may be suitably divided in the peripheral portions at the back and the face sides respectively.

What is claimed:

1. A golf club head comprising:

a head body having a face and a back;

embedding grooves formed along peripheral portions of the face and back of said head body;

two separate balance weights formed of a material denser than that of said head body, comprising: a first balance weight provided along a peripheral portion of the face of said head body; a second balance weight provided along a peripheral portion of the back of said head body, said balance weights being press-fitted into said embedding grooves, wherein a dimension of said second balance weight in the face-to-back direction is greater than that of said first balance weight on the average.

2. A golf club head according to claim 1, further comprising:

a cavity which is machined in an area on the back of said head body, said cavity being surrounded by said second balance weight;

a cover portion which is formed integral with said head body, said cover portion covering an inner surface of said second balance weight.

3. A golf club head comprising:

a head body having a face and a back;

two separate balance weights formed of a material denser than that of said head body, comprising: a first balance weight provided along a peripheral portion of the face of said head body; a second balance weight provided along a peripheral portion of the back of said head body, wherein there is provided a weight-sole portion integral with a lower portion of said second balance weight provided at the back side, said weight-sole portion extending toward a sole.

4. A golf club head according to claim 3, wherein said weight-sole portion is widened both at its toe and heel sides relative to its intermediate portion.

* * * * *